US007604520B2

(12) United States Patent
Kotlyar

(10) Patent No.: US 7,604,520 B2
(45) Date of Patent: Oct. 20, 2009

(54) ELECTRICAL LINEAR MOTOR FOR MARINE PROPULSION

(76) Inventor: Oleg Kotlyar, 4675 W. 3825 South, Salt Lake City, UT (US) 84120

( * ) Notice: Subject to any disclaimer, the term of this patent is extended or adjusted under 35 U.S.C. 154(b) by 66 days.

(21) Appl. No.: 11/881,890

(22) Filed: Jul. 30, 2007

(65) Prior Publication Data

US 2009/0036005 A1 Feb. 5, 2009

Related U.S. Application Data

(60) Provisional application No. 60/834,611, filed on Jul. 31, 2006.

(51) Int. Cl.

| | |
|---|---|
| ***B63H 21/17*** | (2006.01) |
| ***B63H 11/06*** | (2006.01) |
| ***F04B 17/04*** | (2006.01) |
| ***H02K 33/00*** | (2006.01) |
| ***H02K 33/16*** | (2006.01) |
| ***H02K 33/18*** | (2006.01) |

(52) U.S. Cl. ..... 440/6; 440/17; 440/18; 440/38; 60/221; 417/416; 310/15

(58) Field of Classification Search ..... 440/6, 440/17–20, 38, 44, 45, 47; 114/337; 60/221, 60/222, 595, 596, 911; 417/415–419; 310/15–24, 310/36–39

See application file for complete search history.

(56) References Cited

U.S. PATENT DOCUMENTS

| | | | | |
|---|---|---|---|---|
| 3,740,171 | A * | 6/1973 | Farkos | 417/418 |
| 4,692,673 | A * | 9/1987 | DeLong | 318/132 |
| 5,203,172 | A * | 4/1993 | Simpson et al. | 60/545 |
| 5,828,143 | A * | 10/1998 | Kotlyar | 310/26 |

FOREIGN PATENT DOCUMENTS

WO WO 01/25084 A1 * 4/2001

* cited by examiner

*Primary Examiner*—Ajay Vasudeva

(57) ABSTRACT

An electrical linear motor for propelling a marine vessel comprises a thruster assembly disposed within a guide tube. Permanent magnets are attached to the thruster assembly and placed in close proximity to electrical coil windings, which are positioned outside of and parallel to the guide tube. Electrical current energizing the coil windings creates an electromagnetic field, which interacts with the magnetic field of the magnets to cause reciprocating linear motion of the thruster assembly with the guide tube. During the non-propelling back stroke, a check valve on the thruster assembly is in open position to allow free passage of water. The check valve is moved to a closed position during the working stroke of the thruster assembly, allowing the thruster assembly to propel the marine vessel.

16 Claims, 5 Drawing Sheets

ELECTRICAL LINEAR MOTOR FOR MARINE PROPULSION

CROSS-REFERENCE TO RELATED APPLICATIONS

This application claims the benefit of the U.S. provisional patent application Ser. No. 60/834,611, filed on Jul. 31, 2006, and is incorporated by reference.

TECHNICAL FIELD

The present invention relates to a method and apparatus for propelling an object through a medium using an electrical linear motor (ELM).

BACKGROUND OF THE INVENTION

Electrical linear motors are used to propel vehicles. For example, linear motors are used for maglev trains and other ground-based transportation applications. These types of linear motors are usually of the linear synchronous design, with an active winding on one side of an air-gap and an array of alternate pole magnets on the other side. These magnets can be permanent magnets or energized magnets.

Electrical rotary motors are used to propel vehicles and marine vessels, such as boats and submarines. Electrical rotary motors for marine vessels utilize propellers to transform the rotary motion mechanical energy into working propulsion linear force. One of the disadvantages of utilizing propellers to propel a marine vessel is that the propeller creates a water rotational movement (swirl) in the water, thereby making the vessel more easily detected.

Using electrical linear motors for propelling a marine vessel, submarines, or torpedoes have several advantages over electrical rotary motors. For example, electrical linear motors can produce up to 3000 lbs of linear driving force and therefore can provide increased velocities of the vessels. Also, the acceleration rate of electrical linear motors is up to 10 g. Electrical linear motors directly transform its electrical energy into the ELM propulsion linear force and therefore as a vessel's drive ELMs are simple, requiring few moving parts and not requiring mechanical transmissions, such as propellers. As a result, ELMs are more reliable than rotary motors. The operation of electrical linear motors does not create pollution to the environment and are more energy efficient that electrical rotary motors. The new simple ELM drive can be based on direct current (DC) or alternating current (AC).

SUMMARY OF THE INVENTION

Aspects of the invention relate to employment of the electrical linear motor propulsion system to propel an object through a medium, such as water. In one aspect of the invention comprises an electrical linear motor(s) placed into the housing, which secured to the vessel and submerged in the water; a guide tube disposed within the housing, the guide tube having an axial length, an inlet and outlet; electrical linear motor coil windings within the housing are connected with it and positioned parallel to the axial length of the guide tube; permanent magnets are attached to movable linear motor part—thruster subassembly, the permanent magnets being maintained in sufficiently close proximity to the electrical coil windings so that an electromagnetic field created by the controlled energizing of the electrical coil windings interacts with a magnetic field from the permanent magnets to provide reciprocal linear motion of the thruster subassembly within the guide tube; the thruster subassembly having an opposing first and second ends and a check valve installed in the thruster subassembly internal channel, the check valve being in an open position during a back stroke of the thruster subassembly so that the water enters the guide tube through the guide tube inlet and the thruster assembly first and second ends, thereby substantially filling the guide tube with water which passes through the thruster subassembly, the check valve being in a closed position during a work stroke of the thruster subassembly so that the water within the guide tube is forced out of the guide tube outlet thereby providing sufficient reciprocating force to propel the vessel through the water.

Another aspect of the invention provides a method for propelling a vessel through a medium, comprising a reciprocating movable thruster subassembly within a guide tube, the reciprocating thruster subassembly movement being caused by generating and controlling an electromagnetic field by energizing stationary electrical coil winding(s), the controlled electromagnetic field interacting with a magnetic field of permanent magnets attached to the thruster subassembly to provide reciprocal linear motion consisting of a working stroke and a back stroke of the thruster subassembly, whereby water fills the guide tube during the back stroke of the reciprocating thruster subassembly and discharged from the guide tube during the working stroke of the reciprocating thruster subassembly, the discharge of water from the guide tube thereby providing sufficient force to propel the vessel through the water.

Another aspect of the invention includes the attachment of the linear motor(s) housing to the vessel. For example, the electrical linear motor winding(s) can be rigidly attached to the linear motor housing, which in it turn is connected with vessel, thereby providing propulsion system with one degree of freedom-thruster subassembly with magnets movement along the longitudinal axis of the thruster block housing tube. Alternatively, the linear motor housing can be attached to the vessel by means of a 360° rotatable shaft. Such a configuration provides propulsion system with two degrees of freedom for movable thruster subassembly—linear movement along the longitudinal axis of the housing tube and thruster subassembly rotation with shaft. Due to these two movements the propulsion linear force vector can be directed in any direction within 360 in plane. Additionally, the linear motor housing can be attached to the vessel by using a 360° rotatable shaft and coupling hinge between the vessel and thruster block housing. This provides to propulsion system three degrees of freedom and results in a highly maneuverable vessel and especially submarine.

An additional aspect of the invention includes the use of several linear motors to propel the marine vessel. The several of linear motors can be attached to the vessel as stated above, (i.e., rigidly attached, attached to rotatable shaft, or rotatable/coupling hinge attachment). The numerous of linear motors that are rigidly attached to the vessel are preferably mounted on opposing sides of the vessel's longitudinal axis, with the longitudinal axis of the linear motors being parallel to the longitudinal axis of the vessel. An advantage of several linear motors is that greater linear propulsion force is generated, and turning the vessel is accomplished by controlling the relative propulsion force generated by each of the several electrical linear motors.

DETAILED DESCRIPTION OF THE PREFERRED EMBODIMENTS

Figure 1:
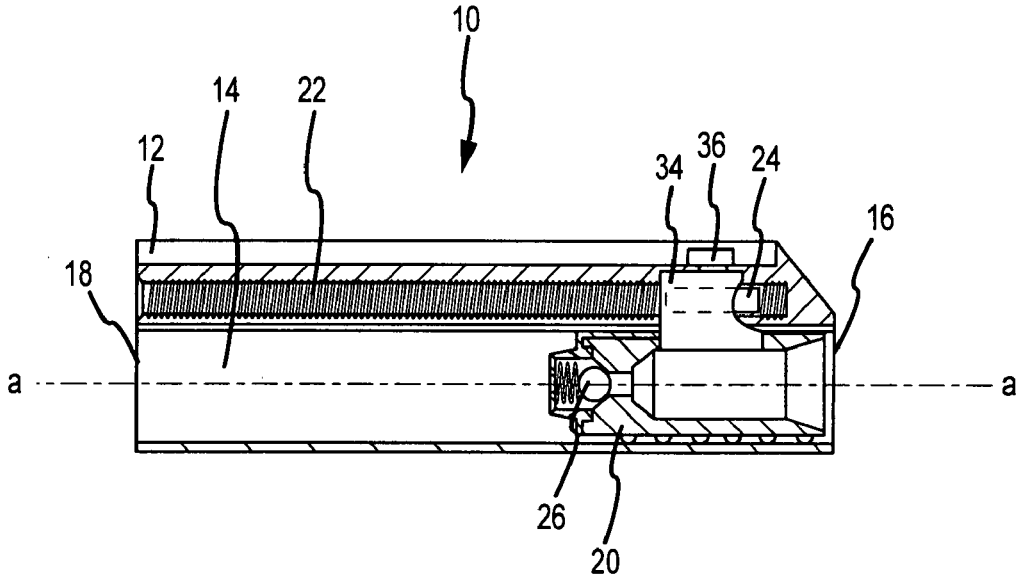
FIG. 1 is a cross sectional side view of the electrical linear motor of the present invention.

Referring to FIG. 1, there is disclosed an embodiment of an electrical linear motor 10 and linear motor housing 12 of the present invention. The linear motor housing 12 is submerged in the medium through which a vessel is to be propelled. For example the object could be a boat on the water surface and having the linear motor housing submerged in the water, or alternatively the object could be a submarine completely submerged under the water. For purposes of this application, the term "medium" will generally hereinafter be referred to as water, it being acknowledged that medium could consist of any liquid material. The housing 12 contains a guide tube 14 having an axial length, and opposing ends 16 and 18.

Thruster subassembly 20 is located within the guide tube 14 and is capable of reciprocating linear motion along the axial length of guide tube 14. The thruster subassembly reciprocating linear motion is caused by the interaction of an electromagnetic field created by energizing electrical linear motor coil winding(s) 22, which is connected with housing 12 and is disposed within the housing 12 along the axial length of the guide tube 14, and the magnetic field created by electrical linear motor permanent magnets 24 that are attached to the thruster subassembly 20. By controlling the electrical current flowing through coil winding(s) 22, it is possible to control the speed and linear direction of the reciprocating thruster subassembly 20.

A change of the thruster subassembly 20 direction of the movement inside of guide tube 14 can be achieved for example:

a. for DC electrical linear motors—by controllable winding 22 current direction change; and b. for AC electrical linear motors—by controllable stator winding 22 magnetic flow rotation direction change.

Additionally a change of the thruster subassembly 20 speed inside of the guide tube 14 can be achieved by coil winding(s) current frequency change. This method of thruster subassembly speed regulation can be used for AC electrical linear motors. For DC linear motors, the speed of the reciprocating thruster subassembly can be increased/decreased by increasing/decreasing the value of the winding(s) 22 current.

One way to significantly increase propulsion linear force is to place both two or more sets of permanent magnets 24 on thruster subassembly 20 and one common (or several separate) coil winding 22. Another way to increase propulsion force is to employ simultaneously multiple separate electrical linear motors 10 to propel the vessel or submarine. A large propulsion force will provide both a vessel and submarine high speed and therefore increased maneuverability.

The thruster subassembly 20 includes a check valve 26 that is in a closed position during a thruster subassembly 20 working stroke so that the front part of the thruster subassembly 20 interacts with adjacent layers of water with its full front cross section. As a result, two forces are present at the area of contact. The first one is applied to water and tries to displace the water. The second force is a force of reaction, which is applied to the front part of the thruster body. That force is transmitted through the thruster subassembly 20 and the ELM magnetic fields to the non-moving ELM part (i.e., winding(s) 22), then to the linear motor housing 12 and then to the vessel's hull, thereby stipulating the movement of the vessel. The electrical linear motor propels the vessel as if pushing itself off the water. During the back stroke, the check valve 26 is in an open position that provides a free passage for water flow going through the thruster subassembly internal channel and check valve and therefore a fast thruster subassembly back stroke. A continuous repetition of the working stroke/back stroke process provides continuous propulsion of the vessel through the media.

In order to maintain the permanent magnets 24 in close proximity to the electrical coils winding(s) 22, and to maintain the position of the thruster subassembly 20 within the guide tube 14, the thruster subassembly 20 has a fin 34 attached thereto. A distal end of the fin 34 has a roller restrictor 36, which consists of a roller bearing made of non-corrosive materials. The roller restrictor 36, being in contact with linear motor housing 12 during working/back strokes, prevents physical contact between the fin 34 and a slit in the guide tube 14 through which the fin 34 passes during the working and back stroke of the thruster subassembly 20.

Figure 2A:
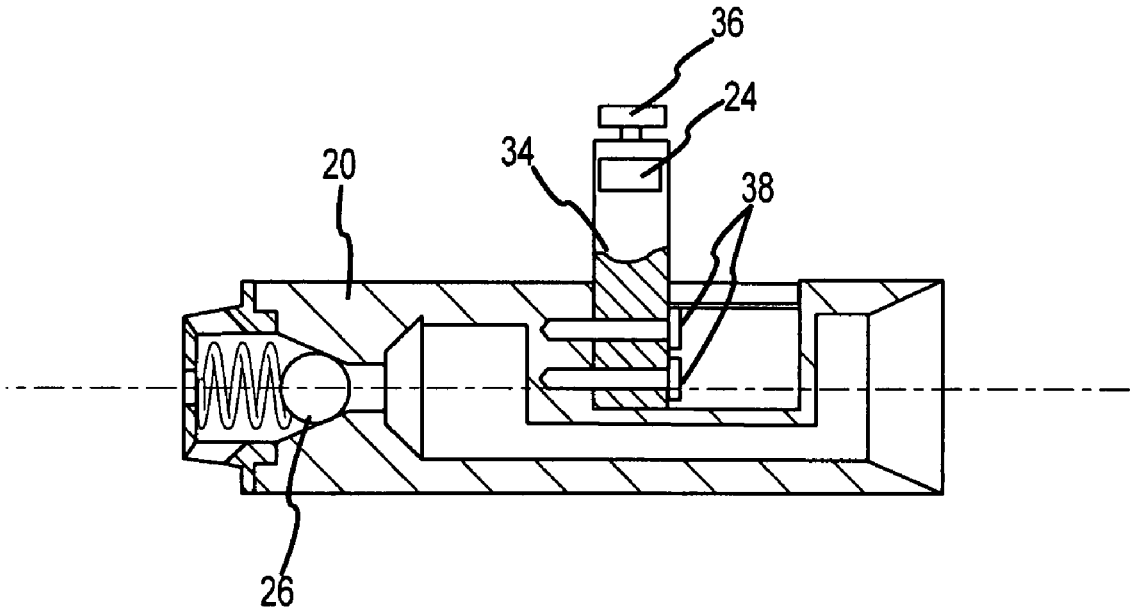
FIG. 2A is a cross sectional side view of the thruster subassembly of the water protected linear motor.
Figure 2B:
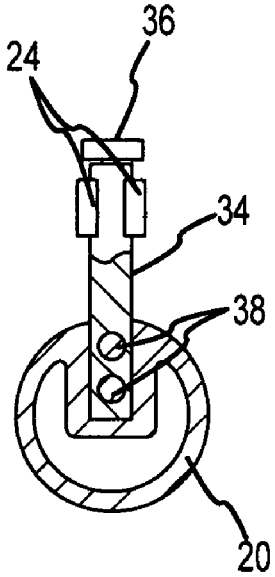
FIG. 2B is a cross sectional view of the thruster subassembly of the water protected linear motor.
Figure 2C:
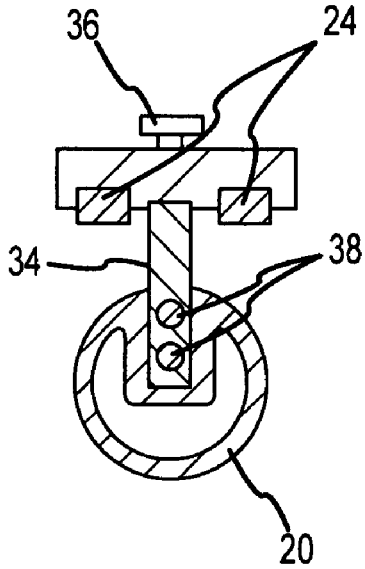
FIG. 2C is cross sectional view of an alternate thruster subassembly of the water protected linear motor.

A cross sectional side view of the thruster assembly 20 is shown in FIG. 2A. As can be seen in FIG. 2A, fin 34 is shown being attached to the thruster assembly 20 by use of bolts 38. FIG. 2B is a cross sectional side view of the thruster assembly 20, having fin 34 attached to the thruster assembly 20. The roller restrictor 36 is attached to the distal end of fin 34. Permanent magnets 24 are shown in FIG. 2B as being on opposing vertical sides of the fin 34. Alternatively, as shown in FIG. 2C, permanent magnets 24 can be mounted to fin 34 in a horizontal configuration. FIGS. 2B and 2C show the opening (internal channel) in the thruster assembly 20 through which water flows through the check valve 26 during the back stroke of subassembly 20 to fill the guide tube 14 and thereby providing a fast back stroke.

Linear ball bearings installed on the thruster subassembly 20 outside diameter and roller restrictor(s) ball bearing(s), made of non-corrosive materials, will reduce friction during thruster subassembly 20 motions. Another embodiment has the ball bearings installation on the internal diameter of the thruster block housing guide tube 14. The linear bearings and roller restrictor(s) bearings hold the permanent magnets 24 in the proper position and distance with respect to winding(s) 22.

Electrical linear motors require (as well as electrical rotary motors) a small gap (δ) between permanent magnets 24 and coil winding(s) 22 since the linear force (F) is inversely proportional to the square of the gap, as represented by the following formula:

$$F \equiv 1/\delta^2$$

Placement of a protective partition in the gap between the winding(s) 22 and the permanent magnets 24 to protect the electrical linear motor from the water environment will significantly reduce a propelling linear force, because the gap (δ) increases. Also, a such protective partition protects just one part of the linear motor—either the winding(s) 22 or permanent magnets (24).

Figure 3:
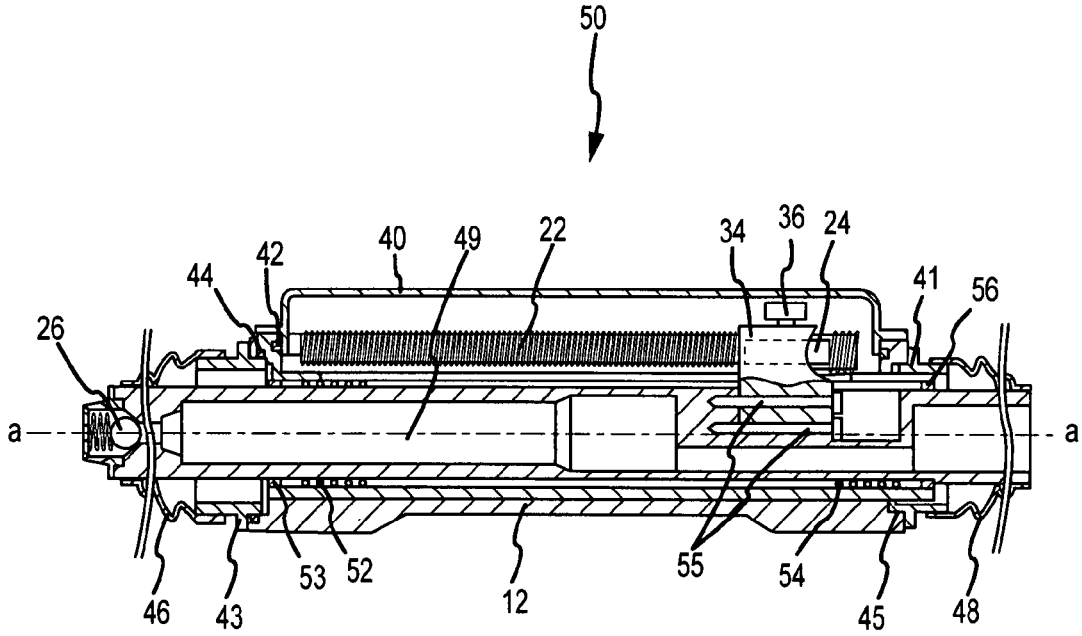
FIG. 3 illustrates a water protected electrical linear motor of the present invention.

There are two approaches to protect linear motor magnets 24 and windings 22 against aggressive water influence: a) for ELM completely placed in medium (water)—to employ known water-proof epoxy and lacquers as a protective coatings, and b) to use a fully water protected linear motor with completely isolated ELMs from the medium, as shown for example in FIG. 3.

As can be seen in FIG. 3, all parts (including the electrical linear motors parts) of the ELM, besides thruster 49 itself, are located within the electrical linear motor housing 12 compartment completely isolated from, and protected against, the water environment by covers 40, 41 and 43, o-rings 42, 44, 45 on the guiding parts, seals for moving parts 53,56 and additional bellows 46 and 48. The thruster itself 49, check valve 26, two sets (for example) of magnets 24 and roller restrictor(s) 36 constitute a moving thruster subassembly 20 of the water protected electrical linear motor 50. Each set of magnets 24 are placed on the thruster subassembly fin 34, one set on each thruster subassembly fin side. Such design, one thruster subassembly with two linear motor permanent magnets sets and one single linear motor winding (or two separate windings) makes it possible to increase the generated linear force, by a factor of two times. The water-protected linear motor 50 has two open type linear ball bearings 52 and 54 guiding the moving thruster subassembly 20. The thruster itself 49 and thruster fin 34, carrying two sets of linear motor magnets 24, are connected by two bolts 55. The two bolt-threaded holes in the thruster body must be blind. The electrical linear motor 10 with linear electrical motor(s) placed in water and water-protected linear electrical motor(s) 50 both are of the present invention can be attached to the vessel or submarine hull in a number of different manners. For example, the each electrical linear motor housing can be rigidly attached to the hull of the vessel (submarine), with the longitudinal axis of the vessel's hull parallel (or coincides in plane) to the longitudinal axis a-a of the linear motor housing guide tube 14. In that case we have an electrical linear motor propulsion system with one degree of freedom. Alternatively the propulsion system may consist of two electrical linear motors placed on opposite sides of, and parallel to, the vessel's longitudinal axis. To turn the vessel one ELM operates at a higher velocity that the other ELM thereby resulting in turning vessel to the side of lower velocity ELM.

Figure 4A:
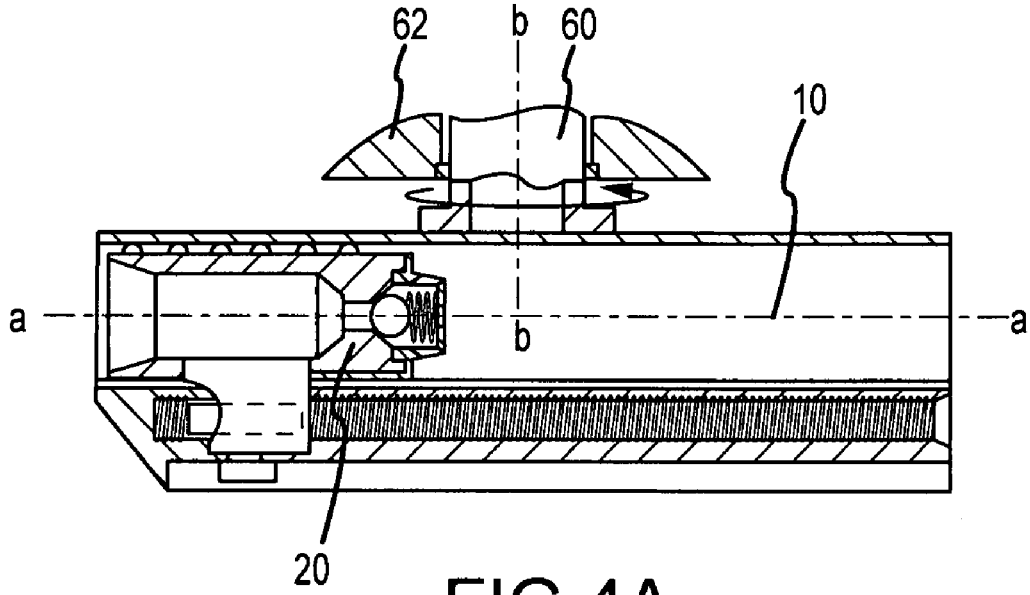
FIG. 4A is a cross sectional side view of the universal electrical linear motor propulsion system attached to a vessel by a rotatable shaft to provide the propulsion system with two degrees of freedom.
Figure 4B:
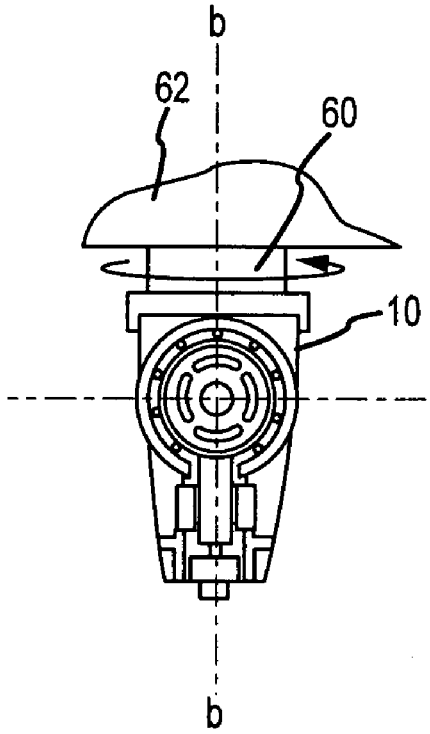
FIG. 4B is a cross sectional end view of the universal electrical linear motor propulsion system of FIG. 4A.

Referring now to FIG. 4A the Universal Electrical Linear Motor Propulsion System (UELMPS-2) electrical linear motor housing can be attached to the vessel's hull by means of a rotatable shaft 60 located between the vessel hull 62 and the thruster blocks 10 or 50. In that case, we have a universal electrical linear motor propulsion system with two degrees of freedom (UELMPS-2), in which the thruster subassembly 20 can perform two independent movements: first, along the axis a-a within working and back strokes, and second, around axis b-b within 360 degrees. Such combination of movements provides the needed two dimensional spatial position of the propulsion linear force vector in a plane to provide the vessel with greater maneuverability. Installation of two UELMPS-2 on a submarine (one UELMPS-2 on each side) for example, with rotatable shaft connecting UELMPS-2 with the submarine hull located in a horizontal plane, will provide the submarine with high maneuverability, including during operations associated with descending and ascending. To perform the turns, only one UELMPS-2 will work, turning submarine to the side of the non-working thruster block. FIG. 4B shows the end view of the rotatable shaft 60 securing the UELMPS-2 housing 12 to the vessel hull 62

Figure 5A:
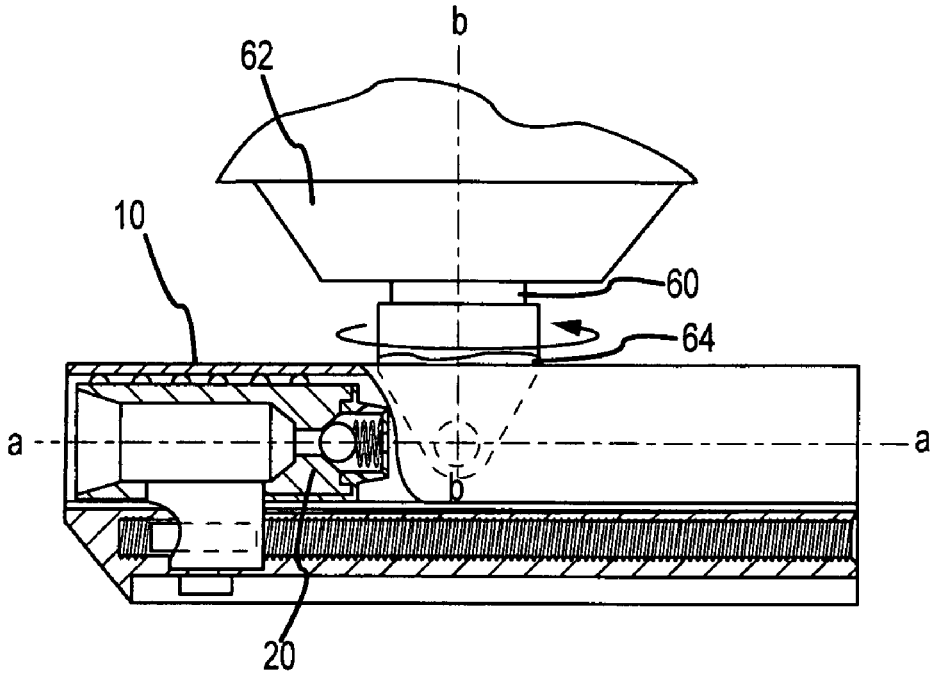
FIG. 5A is a cross sectional side view of the universal electrical linear motor propulsion system attached to a vessel by a rotatable shaft and coupling hinge to provide the propulsion system with three degrees of freedom.
Figure 5B:
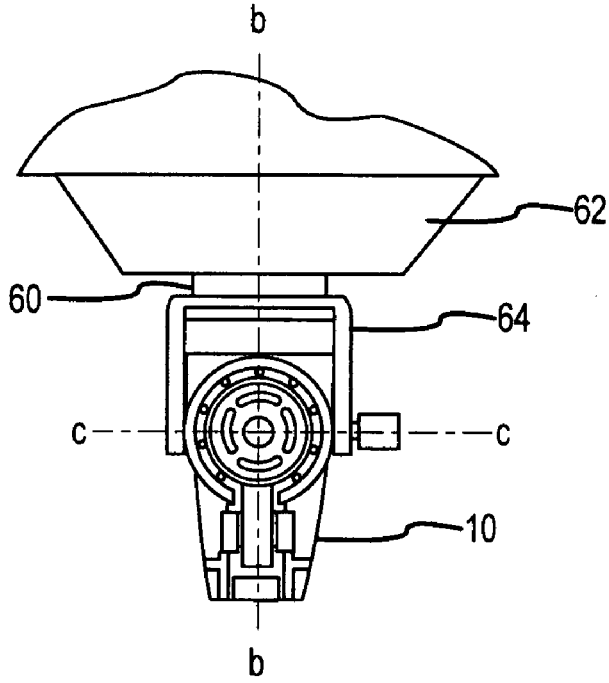
FIG. 5B is a cross sectional end view of the universal electrical linear motor propulsion system of FIG. 5A.

Referring now to FIG. 5A, the thruster blocks 10 or 50 can be attached to the vessel hull by using a rotatable shaft 60 and coupling hinge 64 connected to the linear motor housing 12. In that case we have a universal electrical linear motor propulsion system with three degrees of freedom (UELMPS-3) in which the thruster subassembly 20 can perform three independent movements: first, along the axis a-a with working and back strokes, second—turns around the axis b-b within 360 degrees, and third—turns around axis c-c, thereby providing the needed three dimensional spatial position of the propulsion linear force vector and stipulating by this an extremely high maneuverability of the vessels and especially submarines.

As previously mentioned, multiple UELMPS-2 or -3 of the present invention can be attached to the vessel to increase both the force generated by the electrical linear motors and thereby velocity of the vessel and its maneuverability. Additionally by using UELMPS-2 or -3 attached to the vessel on opposing sides of the vessel, it is possible to control the direction of the vessel by relatively controlling the velocities of the UELMPS-2 or -3. For example, increasing the throughput of the linear motor(s) on one side of the vessel will cause the vessel to turn in the opposite direction, while decreasing the throughput on one side will create a turn in that direction. Furthermore, increasing the throughput of linear motor(s) on one side of the vessel, while decreasing the throughput of the linear motors on the opposite side of the vessel, will accelerate the turn of the vessel.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An electrical linear motor on a marine vessel for propelling the marine vessel through a liquid medium, comprising:

a housing secured to the marine vessel and submerged in the liquid medium;

a guide tube disposed within the housing, the guide tube having an axial length, an inlet and an outlet;

electrical coil windings disposed within the housing and positioned parallel to the axial length of the guide tube, the electrical coil windings configured for being energized by electric current;

a thruster subassembly disposed within the guide tube and configured for reciprocating linear motion, the thruster subassembly having opposing first and second ends and a check valve;

permanent magnets attached to the thruster subassembly, the permanent magnets disposed outside the guide tube and maintained in sufficiently close proximity to the electrical coil windings so that an electromagnetic field created by energizing the electrical coil windings interacts with a magnetic field from the permanent magnets to provide a reciprocating linear motion to the thruster subassembly within the guide tube;

wherein the check valve is in an open position during a back stroke of the thruster subassembly so that the liquid medium enters the guide tube through the guide tube inlet and the thruster assembly first and second ends, thereby substantially filling the guide tube with the liquid medium, and wherein the check valve is in a closed position during a work stroke of the thruster subassembly so that the medium within the guide tube is forced out of the guide tube outlet thereby providing sufficient force to propel the marine vessel through the liquid medium.

2. The electrical linear motor of claim 1 wherein the housing is rigidly secured to the vessel.

3. The electrical linear motor of claim 1 wherein the housing is secured to the vessel by a rotatable shaft.

4. The electrical linear motor of claim 3 wherein the housing is secured to the vessel by a coupling hinge interposed between the rotatable shaft and the housing.

5. The electrical linear motor of claim 1 wherein the housing is sealed to prevent the electrical coil windings and the permanent magnets from contacting the liquid medium.

6. The electrical linear motor of claim 1 wherein the permanent magnets are maintained in sufficiently close proximity to the electrical coil windings by a roller restrictor bearing engaging the housing.

7. The electrical linear motor of claim 1 wherein the marine vessel is one of surface vessel, submarine and torpedo.

8. A marine propulsion system for propelling the vessel through a liquid medium, comprising:

a plurality of electrical linear motors, each linear motor further comprising:

a housing secured to the marine vessel and submerged in the liquid medium;

a guide tube disposed within the housing, the guide tube having an axial length, an inlet and an outlet;

electrical coil windings disposed within the housing and positioned parallel to the axial length of the guide tube, the electrical coil windings configured for being energized by electric current;

a thruster subassembly disposed within the guide tube and configured for reciprocating linear motion, the thruster subassembly having opposing first and second ends and a check valve;

permanent magnets attached to the thruster subassembly, the permanent magnets disposed outside the guide tube and maintained in sufficiently close proximity to the electrical coil windings so that an electromagnetic field created by energizing the electrical coil windings interacts with a magnetic field from the permanent magnets to provide a reciprocating linear motion to the thruster subassembly within the guide tube;

wherein the check valve is in an open position during a back stroke of the thruster subassembly so that the liquid medium enters the guide tube through the guide tube inlet and the thruster assembly first and second ends, thereby substantially filling the guide tube with the liquid medium, and wherein the check valve is in a closed position during a work stroke of the thruster subassembly so that the medium within the guide tube is forced out of the guide tube outlet thereby providing sufficient force to propel the marine vessel through the liquid medium.

9. The system of claim 8 wherein the multiple electrical linear motors are rigidly secured to the vessel.

10. The system of claim 8 wherein the housings of the multiple electrical linear motors are each secured to the vessel by rotatable shafts.

11. The system of claim 10 wherein the housings of the multiple electrical linear motors are each secured to the vessel by a coupling hinge interposed between the rotatable shaft and the respective housing.

12. The system of claim 8 wherein the housings are sealed to prevent the electrical coil windings and the permanent magnets from contacting the medium.

13. The system of claim 8 wherein the permanent magnets are maintained in sufficiently close proximity to the electrical coil windings by a roller restrictor bearing engaging the housing.

14. The system of claim 8 wherein the multiple electrical linear motors each have independent rates of reciprocal linear motion.

15. The system of claim 14 wherein the independent rates of linear motion are controlled to control the vessel direction.

16. The electrical linear motor of claim 8 wherein the marine vessel is one of surface vessel, submarine and torpedo.

* * * * *